US009205658B2

(12) United States Patent
Okazaki

(10) Patent No.: US 9,205,658 B2
(45) Date of Patent: Dec. 8, 2015

(54) INK CARTRIDGE AND METHOD OF PRODUCING THE SAME

(71) Applicant: Naoya Okazaki, Hashima-gun (JP)

(72) Inventor: Naoya Okazaki, Hashima-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/217,965

(22) Filed: Mar. 18, 2014

(65) Prior Publication Data

US 2014/0292957 A1 Oct. 2, 2014

(30) Foreign Application Priority Data

Mar. 28, 2013 (JP) ..... 2013-069547

(51) Int. Cl.
*B41J 2/175* (2006.01)
*B41J 2/195* (2006.01)

(52) U.S. Cl.
CPC ..... *B41J 2/17503* (2013.01); *B41J 2/1752* (2013.01); *B41J 2/17523* (2013.01); *B41J 2/17559* (2013.01); *Y10T 29/49117* (2015.01)

(58) Field of Classification Search
CPC ..... B41J 2/17526; B41J 2/175446; B41J 2/17556; B41J 2/17506
See application file for complete search history.

(56) References Cited

U.S. PATENT DOCUMENTS 6,170,939 B1 1/2001 Ujita et al.
6,302,534 B1 10/2001 Tsukahara et al.
6,416,152 B1 * 7/2002 Matsuzaki et al. ..... 347/19
6,539,985 B2 4/2003 Shinada et al.
7,303,271 B2 12/2007 Shimizu et al.
7,645,033 B2 1/2010 Bulman et al.
7,775,645 B2 * 8/2010 Hattori et al. ..... 347/86
8,177,343 B2 5/2012 Yoshiike
8,272,724 B2 9/2012 Kanbe
2001/0050113 A1 * 12/2001 Shinada et al. ..... 141/18

(Continued)

FOREIGN PATENT DOCUMENTS

JP 2000-238283 A 9/2000
JP 2005-111922 A 4/2005

(Continued)

OTHER PUBLICATIONS

Nov. 21, 2014—(US) Notice of Allowance—U.S. Appl. No. 14/218,003.
Co-pending U.S. Appl. No. 14/218,003, filed Mar. 18, 2014.

*Primary Examiner* — Shelby Fidler
*Assistant Examiner* — Tracey McMillion
(74) *Attorney, Agent, or Firm* — Banner & Witcoff, Ltd.

(57) ABSTRACT

An ink cartridge includes a cartridge body defining an ink chamber, an ink supply portion provided at the cartridge body, an air flow path provided in the cartridge body, a cover, and a memory chip disposed on the cover. The cartridge body has an outer surface oriented in a first direction and an air communication port opened on the outer surface. The air flow path communicates with the ink chamber through a communication hole and with ambient air through the air communication port to permit communication between the ink chamber and ambient air. The cover covers the outer surface of the cartridge body and has an opening at a position aligned with the air communication port in the first direction. The memory chip closes the opening and stores information. External access to the memory chip permits information to be electrically retrieved therefrom.

12 Claims, 9 Drawing Sheets

(56) References Cited

U.S. PATENT DOCUMENTS

| | | | | |
|---|---|---|---|---|
| 2001/0052370 | A1 | 12/2001 | Shinada et al. | |
| 2003/0048337 | A1* | 3/2003 | Jones et al. | 347/86 |
| 2006/0000802 | A1 | 1/2006 | Kumar et al. | |
| 2007/0017898 | A1 | 1/2007 | Kumar et al. | |
| 2008/0239035 | A1* | 10/2008 | Hattori et al. | 347/86 |
| 2010/0194830 | A1 | 8/2010 | Yoshiike | |
| 2011/0122208 | A1* | 5/2011 | Myers | 347/86 |
| 2012/0188315 | A1 | 7/2012 | Kawate | |

FOREIGN PATENT DOCUMENTS

| | | | |
|---|---|---|---|
| JP | 2005-161641 | A | 6/2005 |
| JP | 2009-096126 | A | 5/2009 |
| JP | 2010-221477 | A | 10/2010 |
| JP | 2011-071527 | A | 4/2011 |
| JP | 2012-152998 | A | 8/2012 |
| WO | 00/58100 | A1 | 10/2000 |

* cited by examiner

INK CARTRIDGE AND METHOD OF PRODUCING THE SAME

CROSS REFERENCE TO RELATED APPLICATION

This application claims priority from Japanese Patent Application No. 2013-069547 filed Mar. 28, 2013. The entire content of the priority application is incorporated herein by reference.

TECHNICAL FIELD

The present invention relates to an ink cartridge provided with an ink chamber and an air flow path configured to permit the ink chamber to communicate with ambient air to bring pressure of the ink chamber into atmospheric pressure. The present invention also relates to a method of producing the ink cartridge.

BACKGROUND

There is known an image recording apparatus that uses ink to record an image onto a recording sheet. This image recording apparatus includes an inkjet type recording head and is configured to selectively spray ink droplets from the recording head toward a recording sheet. The ink droplets are landed onto the recording sheet, thereby a desired image being recorded on the recording sheet. The image recording apparatus can accommodate an ink cartridge having an ink chamber that stores ink to be supplied to the recording head. The ink cartridge is detachably received in an accommodating portion provided in the image recording apparatus.

The ink cartridge to be accommodated in the image recording apparatus is internally sealed, before use, so as to prevent ink stored in the ink chamber from leaking outside. The ink chamber is brought into atmospheric pressure when used. To this end, the ink cartridge is provided with an air flow path through which the ink chamber is permitted to communicate with ambient air. Conventionally, a valve mechanism has been provided in the air flow path to open and close the same. Specifically, such conventional valve mechanism includes a valve body and a biasing member biasing the valve body in a direction to close an air communication port. When the ink cartridge is mounted in the accommodating portion, a rod provided in the accommodating portion pushes the valve body against a biasing force of the biasing member to open the air communication port.

There is also proposed a method to refill ink into a used empty ink cartridge so that such refilled ink cartridge can be used again in an image recording apparatus. For example, International Application Publication No. 2000/58100 and Japanese Patent Application Publication No. 2000-238283 disclose a method of refilling ink into an ink chamber by depressurization of the ink chamber or by suction (discharging) of air from the ink chamber.

SUMMARY

To realize communication with ambient air, the air communication port should be exposed to outside. However, exposure to outside may permit foreign objects (dusts, for example) to enter into the air communication port, causing the air communication port to get stuck with the entered foreign objects. On the other hand, covering the air communication port with something like a cover may hinder the ink refilling operation such as decompression of ink chamber, or may involve an extra operation to remove the cover.

In view of the foregoing, it is an object of the present invention to provide an ink cartridge that can restrain entrance of foreign objects into an air flow path and that can facilitate refilling of ink into the ink cartridge. The present invention also aims to provide a method of producing such ink cartridge.

In order to attain the above and other objects, there is provided an ink cartridge including a cartridge body, an ink supply portion, an air flow path, a cover and a memory chip. The cartridge body defines an ink chamber therein for storing ink, the cartridge body having a first outer surface and an air communication port formed to be open on the first outer surface, the first outer surface being oriented in a first direction. The ink supply portion is provided at the cartridge body and is configured to supply the ink stored in the ink chamber to outside. The air flow path is provided in the cartridge body, the air flow path being configured to be in communication with the ink chamber through a communication hole and in communication with ambient air through the air communication port to permit the ink chamber to communicate with ambient air through the air flow path. The cover covers the first outer surface of the cartridge body, the cover being formed with an opening at a position aligned with the air communication port in the first direction. The memory chip is disposed on the cover to close the opening and is configured to store information, external access to the memory chip permitting the information to be electrically retrieved therefrom.

Incidentally, in the present invention, ink does not necessarily mean colored liquid, but also means colorless liquid, such as colorless liquid used on printing medium to perform finishing (coating) thereon before and after image formation.

According to another aspect of the present invention, there is provided a method of producing the above-described ink cartridge. The method includes: removing the memory chip from the cover of the ink cartridge; decompressing the ink chamber through the air communication port; introducing ink into the decompressed ink chamber through the ink supply portion; and attaching a new memory chip to the cover to close the air communication port.

According to still another aspect of the present invention, there is provided an ink cartridge including a cartridge body, an ink supply portion, an air flow path provided in the cartridge body, a cover and a memory chip. The cartridge body defines an ink chamber therein for storing ink, the cartridge body having an outer surface and an air communication port formed on the outer surface. The ink supply portion is provided at the cartridge body and configured to supply the ink stored in the ink chamber to outside. The air plow path is configured to be in communication with the ink chamber through a communication hole and in communication with ambient air through the air communication port to permit the ink chamber to communicate with ambient air through the air flow path. The cover covers the outer surface of the cartridge body, the cover being formed with an opening for exposing the air communication port through the opening. The memory chip is disposed on the cover to close the opening and configured to store information, external access to the memory chip permitting the information to be electrically retrieved therefrom.

DETAILED DESCRIPTION

1. Overall Structure of Printer

Figure 1:
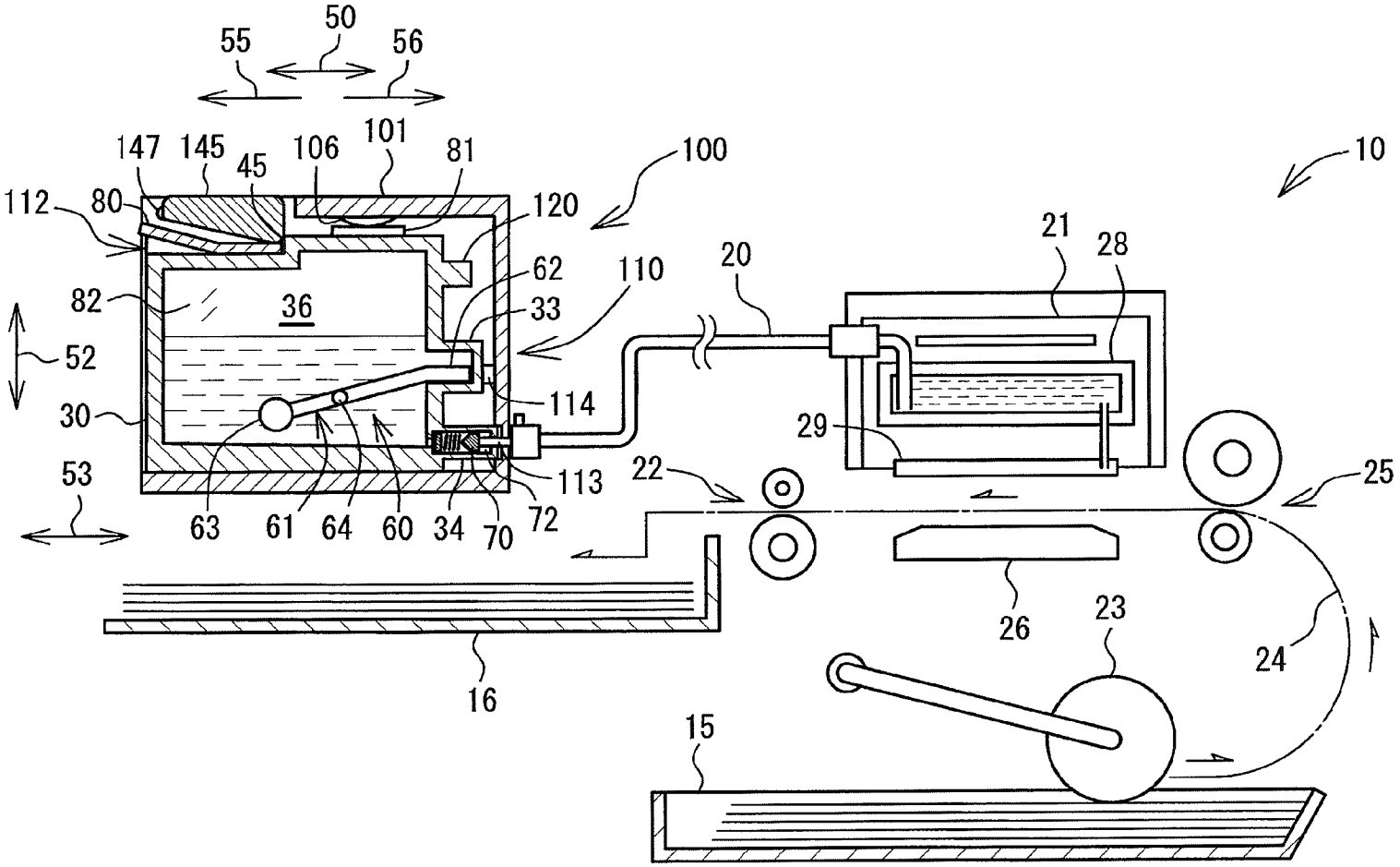
FIG. 1 is a conceptual cross-sectional view showing an internal construction of a printer provided with an cartridge accommodating section that detachably accommodates an ink cartridge according to an embodiment of the present invention.

First, a printer 10 adapted to accommodate the ink cartridge 30 according to an embodiment of the present invention will be described with reference to FIG. 1.

The printer 10 is configured to form an image by ejecting ink droplets onto a sheet in accordance with an ink jet recording system. As shown in FIG. 1, the printer 10 includes an ink supply device 100 provided with a cartridge accommodating section 110 configured to detachably accommodate the ink cartridge 30 therein. The printer 10 also includes a recording head 21 and ink tubes 21 connecting the ink supplying device 100 and the recording head 21.

The cartridge accommodating section 110 has one side formed with an opening 112 exposed to an atmosphere. The ink cartridge 30 can be inserted into and removed from the cartridge accommodating section 110 through the opening 112.

The ink cartridge 30 stores therein an ink to be used in the printer 10. The ink cartridge 30 is connected to the recording head 21 through the corresponding ink tube 20 when the ink cartridge 30 is mounted in the cartridge accommodating section 110. The recording head 21 has a sub tank 28 in which the ink supplied from the ink cartridge 30 through the ink tube 20 is temporarily stored. The recording head 21 also includes a plurality of nozzles 29 through which ink supplied from the sub tank 28 is selectively ejected in accordance with the ink jet recording system.

The printer 10 also includes a sheet supply tray 15, a sheet supply roller 23, a sheet path 24, a pair of transfer rollers 25, a platen 26, a pair of discharge rollers 22, and a discharge tray 16. A sheet of paper is supplied from the sheet supply tray 15 to the sheet passage 24 by the sheet supply roller 23, and is then conveyed to the platen 26 by the pair of transfer rollers 25. Then, the ink is selectively ejected from the recording head 21 onto the sheet passing through the platen 26 to form an inked image on the sheet. The sheet is then discharged onto the discharge tray 16 by the pair of discharge rollers 22.

2. Ink Supply Device

The ink supply device 100 functions to supply ink to the recording head 21, as shown in FIG. 1. As described above, the ink supply device 100 includes the cartridge accommodating section 110 in which the ink cartridge 30 is detachable loadable.

FIG. 1 shows a state where the ink cartridge 30 has been loaded in the cartridge accommodating section 110. In the printer 10 of the present embodiment, the cartridge accommodating section 110 is configured to accommodate four kinds of ink cartridges 30 corresponding to four colors of cyan, magenta, yellow and black, respectively. However, for explanatory purpose, FIG. 1 depicts the cartridge accommodating section 110 that has accommodated only one ink cartridge 30 therein.

Figure 2:
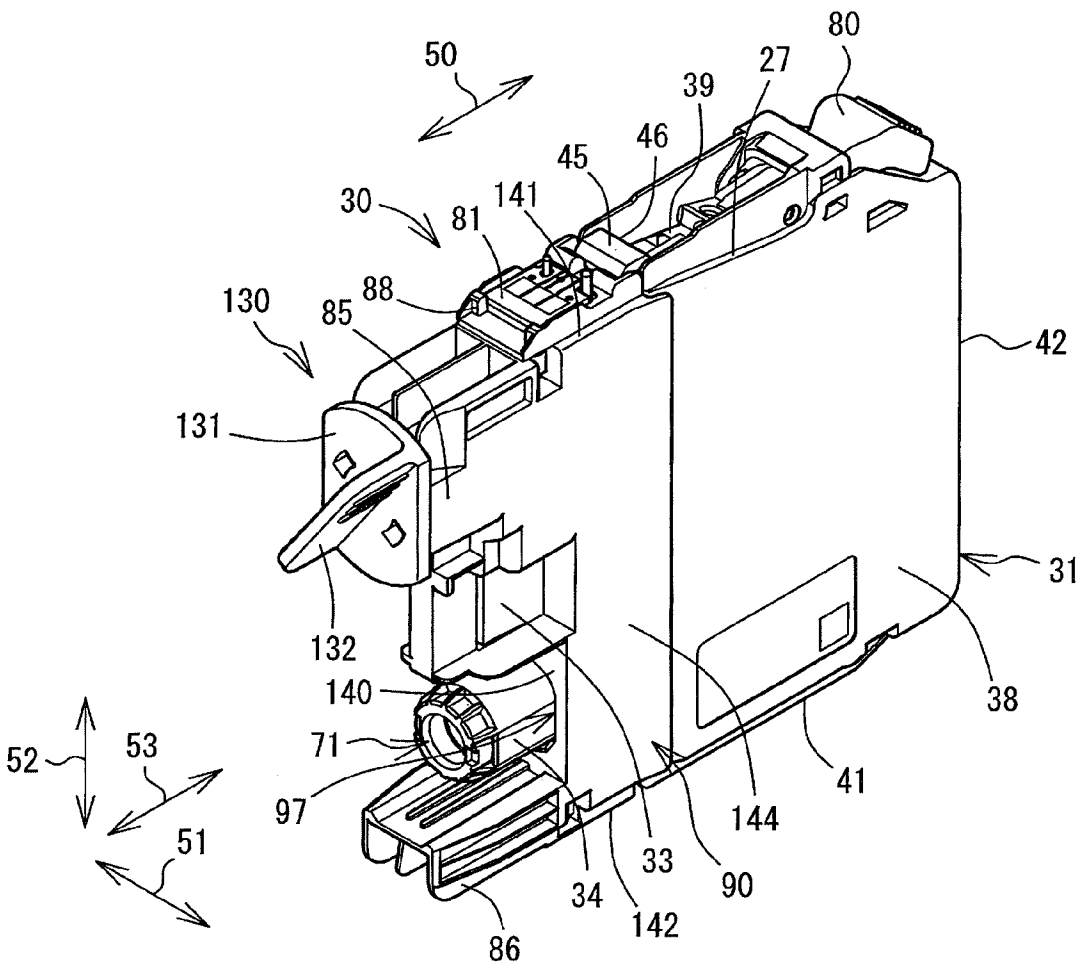
FIG. 2 is a perspective view showing an external appearance of the ink cartridge according to the embodiment, wherein a release member is assembled to the ink cartridge.
Figure 3:
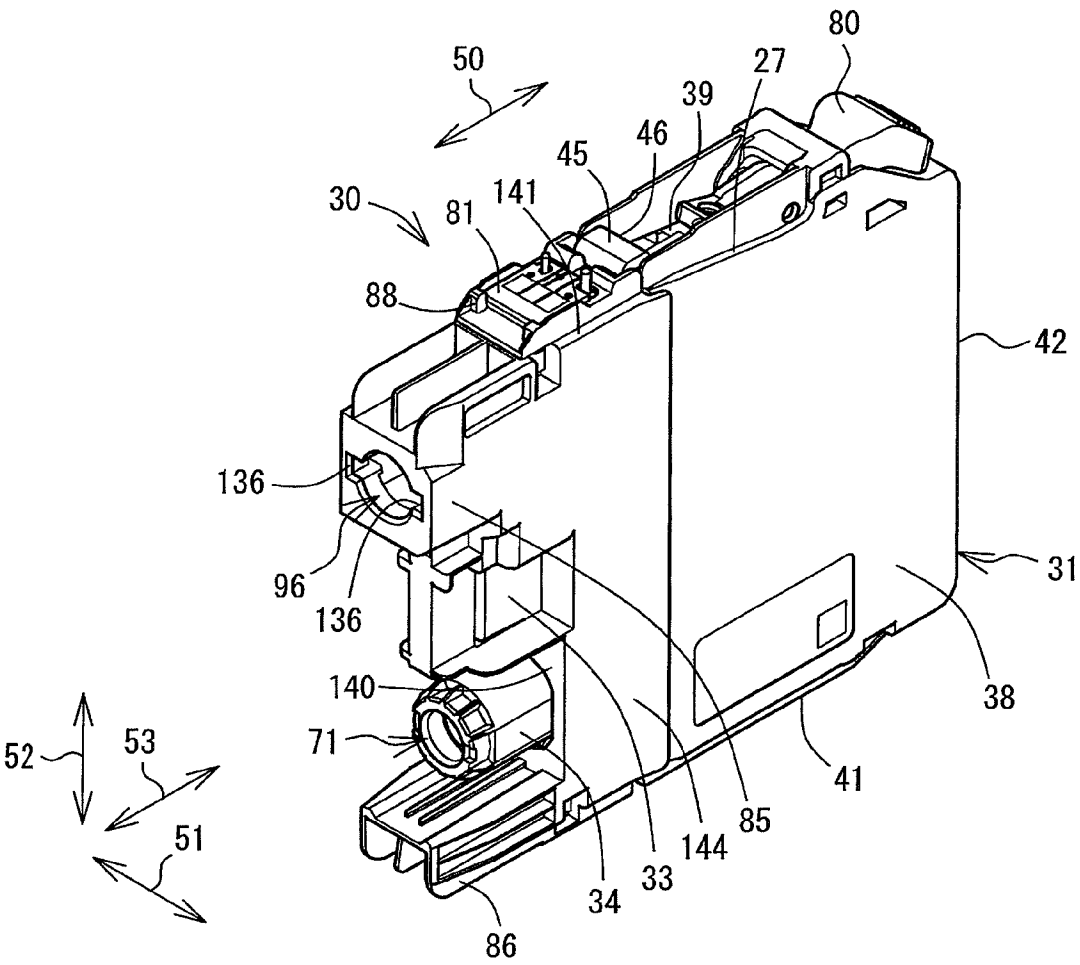
FIG. 3 is a perspective view showing the external appearance of the ink cartridge according to the embodiment, wherein the release member has been removed from the ink cartridge.

The ink cartridge 30 is mounted in and removed from the cartridge accommodating section 110 in an upstanding posture shown in FIGS. 2 to 3. Specifically, the ink cartridge 30 is loaded into the cartridge accommodating section 110 in a loading direction 56, and is unloaded from the cartridge accommodating section 110 in an unloading direction 55 while maintaining the upstanding posture. Hereinafter, the loading direction 56 and the unloading direction 55 may be collectively referred to as a loading/unloading direction 50, whenever necessary, assuming that the loading direction 56 and the unloading direction 55 are interchangeable with each other.

The cartridge accommodating section 110 includes a case 101, an engaging member 145, an ink needle 113 and an optical sensor 114.

The case 101 defines an outer shape of the cartridge accommodating section 110. The ink cartridge 30 is accommodated in the case 101. The case 101 has an end wall opposite the opening 112.

The ink needle 113 is tubular shaped and is formed of a resin. The ink needle 113 is connected to the ink tube 20. The ink needle 113 is disposed at a lower end portion of the end wall of the case 101 to correspond to an ink supply portion 34 (described later) of the ink cartridge 30 mounted in the cartridge accommodating section 110. The ink needle 113 is inserted into an ink supply outlet 71 of the ink supply portion 34 (see FIGS. 2 to 3) when the ink cartridge 30 is being mounted in the cartridge accommodating section 110, thereby opening an ink supply valve 70 provided in the ink supply portion 34. As a result, the ink stored in an ink chamber 36 of the ink cartridge 30 is flowed out therefrom, through an ink passage 72 formed in the ink supply portion 34, into the ink tube 20 connected to the ink needle 113.

The optical sensor 114 is provided on the end wall of the case 101 at a position upward of the ink needle 113 in a gravity direction. The optical sensor 114 includes a light-emitting element (LED, for example) and a light-receiving element (phototransistor, for example). The optical sensor 114 has a horseshoe-shaped housing. The light-emitting element and the light-receiving element are disposed respectively on distal end portions of the horseshoe-shaped housing of the optical sensor 114 to oppose each other. In the present embodiment, the light-emitting element is configured to emit light in a horizontal direction (perpendicular to the loading/unloading direction 50) and the light-receiving element is configured to receive the light emitted from the light-emitting element. The light-emitting element and the light-receiving element define a space therebetween into which a detecting portion 33 of the ink cartridge 30 enters when the ink cartridge 30 is loaded into the cartridge accommodating section 110, as will be described later. When entering this space, the detecting portion 33 alters a path of light formed between the light-emitting element and the light-receiving element, thereby enabling the optical sensor 114 to detect changes in amount of light received by the light-receiving element.

Further, as shown in FIG. 1, the engaging member 145 is provided on an upper wall of the casing 101 at a position adjacent to the opening 112. Four engaging members 145 are provided for receiving four ink cartridges 30 in the present embodiment, but for explanatory purpose, only one engaging member 145 is depicted in FIG. 1. The engaging member 145 is configured to pivot about a shaft 147 provided near the opening 112 on the upper wall. When the ink cartridge 30 is mounted in the cartridge accommodating section 110, the engaging member 145 is configured to engage an engaging portion 45 of the ink cartridge 30 to keep the ink cartridge 30 mounted in the cartridge accommodating section 110 against a biasing force acting in the unloading direction 55, as will be described later.

For removing the ink cartridge 30 from the cartridge accommodating section 110, a user pushes down a rear end portion of a pivot member 80 (described later) provided on the ink cartridge 30 to cause the engaging member 145 to pivotally move counterclockwise. The engagement between the engaging member 145 and the engaging portion 45 is thus released by the pivotal movement of the pivot member 80, thereby permitting the ink cartridge 30 from being removed from the cartridge accommodating section 110.

3. Ink Cartridge

Figure 4:
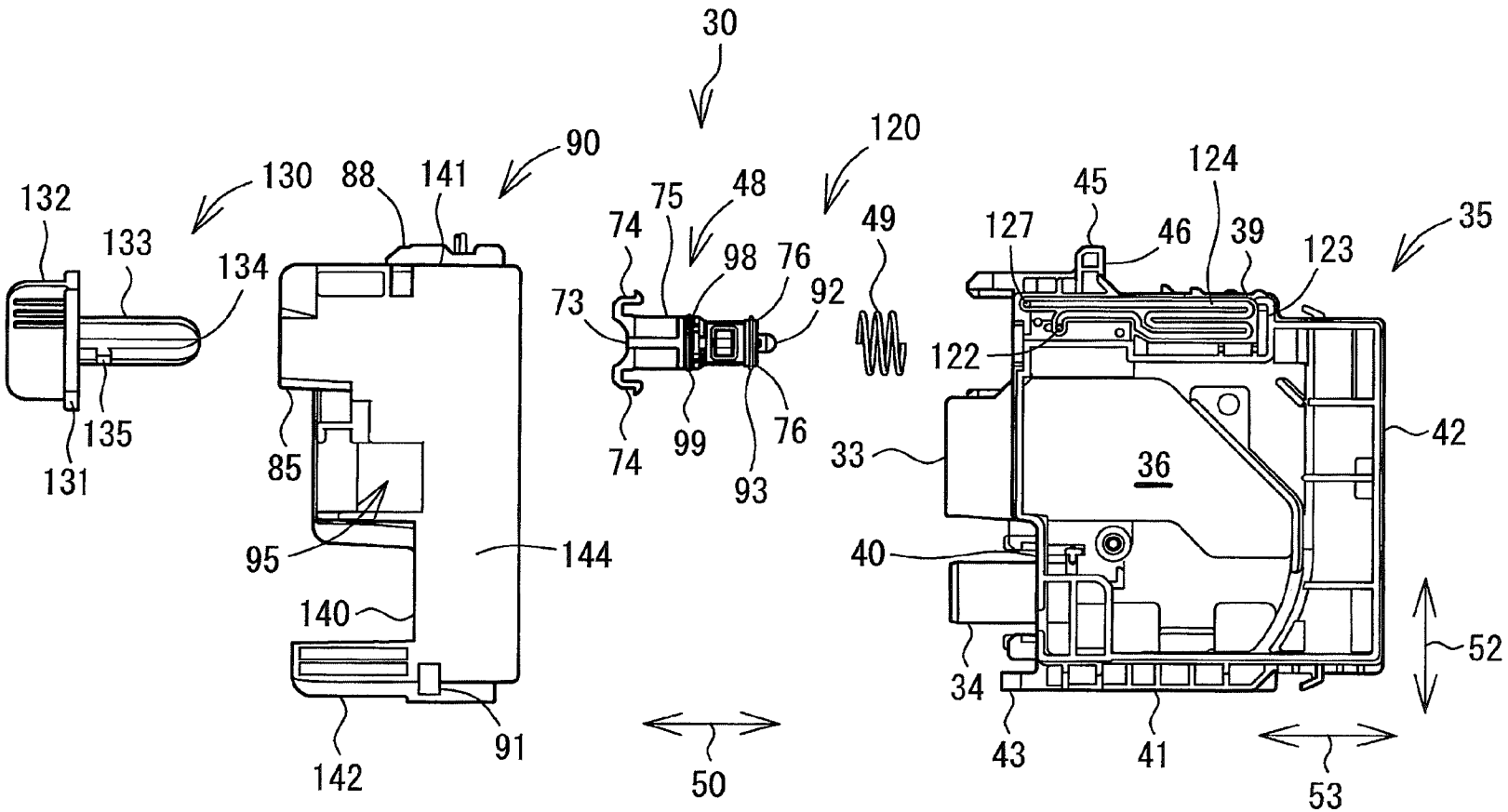
FIG. 4 is an exploded side view showing an internal structure of the ink cartridge according to the embodiment.

The ink cartridge 30 is a container that stores ink therein. The ink cartridge 30 includes a cartridge body 31, a bracket 90, an inner frame 35 accommodated in the cartridge body 31, and a release member 130, as shown in FIGS. 2 to 4.

The ink cartridge 30 defines therein a space for storing ink and this space serves as the ink chamber 36. In the present embodiment, the ink chamber 36 is formed by the inner frame 35 accommodated in the cartridge body 31 and a pair of films 82 (see FIG. 1) attached to the inner frame 35. Alternatively, the ink chamber 36 may be defined by the cartridge body 31 itself.

The bracket 90 is assembled to the cartridge body 31 to form an outer shape of the ink cartridge 30. The inner frame 35 is housed within the cartridge body 31 and the bracket 90 assembled to each other.

In an assembled state, the ink cartridge 30 has a generally flat rectangular parallelepiped shape in outer appearance. The ink cartridge 30 has a width (in a direction indicated by an arrow 51 which will be referred to as widthwise direction), a height (in a direction indicated by an arrow 52 which will be referred to as height direction or vertical direction) and a depth (in a direction indicated by an arrow 53 which will be referred to as depthwise direction), the height and depth being greater than the width. In other words, side surfaces opposing each other in the widthwise direction 51 are surfaces with a largest area among surfaces constituting the ink cartridge 30.

The loading/unloading direction 50 of the ink cartridge 30 relative to the cartridge accommodating section 110 is coincident with the horizontal direction, or the depthwise direction 53 in the present embodiment. However, loading and unloading of the ink cartridge 30 relative to the cartridge accommodating section 110 may be performed in a direction parallel to a vertical direction, or a direction intersecting with both of the vertical and horizontal directions.

Hereinafter, whenever necessary, directions with respect to the ink cartridge 30 will be defined based on the upstanding posture shown in FIG. 2. That is, a leading side of the ink cartridge 30 in the loading direction 56 is referred to as the front side of the ink cartridge 30, whereas a trailing side of the ink cartridge 30 in the unloading direction 55 is referred to as the rear side of the ink cartridge 30. Specifically, the side at which the ink supply portion 34 is provided is the front side of the ink cartridge 30, whereas the side opposite to the side at which the ink supply portion 34 is provided in the depthwise direction 53 is the rear side of the ink cartridge 30. The front-rear direction is thus coincident with the depthwise direction 53 in the present embodiment.

(3-1) Cartridge Body

The cartridge body 31 is box-like shaped to have a hollow space defined therein for housing the inner frame 35. The cartridge body 31 includes a pair of side walls 37 and 38 opposed to each other in the widthwise direction 51 (the side wall 37 is not shown in drawings), and upper and lower walls 27 and 41 opposed to each other in the height direction 52. The cartridge body 31 also includes a rear wall 42 that serves as a trailing end of the ink cartridge 30 in the loading direction 56. The four walls 37, 38, 27, and 41 extend from the rear wall 42 in the depthwise direction 53. The cartridge body 31 is also formed with an open surface opposed to the rear wall 42 in the depthwise direction 53. The inner frame 35 is inserted into the space formed inside the cartridge body 31 through this open surface. When the inner frame 35 is accommodated in the cartridge body 31, the inner frame 35 is partially exposed from the cartridge body 31. That is, the cartridge body 31 covers a rear portion of the inner frame 35.

As illustrated in FIG. 1, the pivot member 80 is provided on the upper wall 27 of the cartridge body 31. The pivot member 80 has a bent plate-like shape and is disposed to extend in the depthwise direction 53. The pivot member 80 has a bent portion in which a pivot shaft (not illustrated) is provided. The pivot member 80 is configured to pivot about this pivot shaft. The pivot member 80 has a portion extending from the bent portion toward an engaging surface 46 (described later) formed in the engaging portion 45 of the cartridge body 31, and another portion extending from the bent portion toward the rear wall 42. That is, the pivot member 80 is configured of a portion frontward of the pivot shaft (frontward portion) and another portion rearward of the pivot shaft (rearward portion). When the ink cartridge 30 is loaded in the cartridge accommodating section 110, the frontward portion of the pivot member 80 is positioned below the engaging member 145. The rearward portion of the pivot member 80 is pressed down by a user when the ink cartridge 30 is removed from the cartridge accommodating section 110 to release the engagement between the engaging member 145 and the engaging portion 45.

(3-2) Bracket

The bracket 90 has a box-like shape and is configured of a pair of side walls 143 and 144 opposed to each other in the widthwise direction 51 (the side wall 143 is not shown in drawings), and upper and lower walls 141 and 142 opposed to each other in the height direction 52. The bracket 90 also has a front wall 140 that opposes the rear wall 42 of the cartridge body 31 in the depthwise direction 53 when the bracket 90 is assembled to the cartridge body 31. This front wall 140 serves as a leading end of the ink cartridge 30 when the ink cartridge 30 is being mounted in the cartridge accommodating section 110 in the loading direction 56. The four walls 143, 144, 141, and 142 extend from the front wall 140 in the depthwise direction 53. The bracket 90 also has an open surface that opposes the front wall 140 in the depthwise direction 53 when the bracket 90 is assembled to the cartridge body 31. The inner frame 35 is inserted inside the bracket 90 through this open surface. That is, the bracket 90 covers a front portion of the inner frame 35 that is not covered by the cartridge body 31.

When the bracket 90 is assembled to the cartridge body 31, the upper wall 141 of the bracket 90 and the upper wall 27 of the cartridge body 31 are in continuous with each other to constitute an upper wall of the ink cartridge 30. Similarly, the lower wall 142 of the bracket 90 and the lower wall 41 of the cartridge body 31 are in continuous with each other to constitute a lower wall of the ink cartridge 30. The side walls 143 and 144 of the bracket 90 and the side walls 37 and 38 of the cartridge body 31 constitute side walls of the ink cartridge 30, respectively. Further, in the assembled state of the ink cartridge 30, the front wall 140 of the bracket 90 constitutes a front wall of the ink cartridge 30 and the rear wall 42 of the cartridge body 31 constitutes a rear wall of the ink cartridge 30.

Incidentally, while the bracket 90 covers the side walls 37 and 38 of the cartridge body 31 in the embodiment, the bracket 90 may not necessarily cover the side walls 37 and 38 of the cartridge body 31 when assembled to the cartridge body 31. For example, the bracket 90 may be assembled to the cartridge body 31 such that the bracket 90 only covers the upper wall 27 of the cartridge body 31. That is, the bracket 90 may cover only one surface of the cartridge body 31.

In the present embodiment, the direction in which the front and rear walls of the ink cartridge 30 (front wall 140 and rear wall 42) oppose each other (i.e., depthwise direction 53) is the front-rear direction (horizontal direction) and coincides with the loading/unloading direction 50. Thus, the direction in which the upper and lower walls of the ink cartridge 30 (upper walls 141, 39 and lower walls 142, 41) oppose each other (i.e., height direction 52) is coincident with the vertical direction (gravity direction).

A through-hole 95 is formed in the bracket 90 to penetrate each of the side walls 143 and 144 in the widthwise direction 51 at a position substantially center in the height direction 52 and adjacent to the front wall 140. The through-hole 95 functions to expose the detecting portion 33 of the inner frame 35 when the inner frame 35 is accommodated in the bracket 90. Thus, the through-hole 95 is formed so as to correspond to the detection portion 33 of the inner frame 35 in terms of position, dimension, and shape.

An elongated hole 91 is also formed in a lower end portion of each of the side walls 143, 144 of the bracket 90. When the bracket 90 is assembled to the cartridge body 31 in which the inner frame 35 has been accommodated, these elongated holes 91 are configured to engage with engagement claws 43 provided on the inner frame 35.

The front wall 140 is formed with a hole 96 at a position upward of the through-hole 95 in the height direction 52. The hole 96 penetrates the front wall 140 in the depthwise direction 53. In a state where the bracket 90 is assembled to the cartridge body 31, the hole 96 serves to receive the release member 130 functioning to open a sealed air communication portion 120 formed in the inner frame 35, as will be described later. When the bracket 90 is assembled to the cartridge body 31 as shown in FIG. 2, the hole 96 is positioned frontward of a protruding end of the ink supply portion 34 in the front-rear direction (depthwise direction 53), as will be described later.

On a peripheral wall defining the hole 96, a pair of cutouts 136 is formed to extend radially outward from the hole 96. Specifically, the cutouts 136 are positioned to diametrically oppose each other via the hole 96 in the widthwise direction 51.

The front wall 140 is also formed with a hole 97 at a position below the through-hole 95 with respect to the height direction 52. The hole 97 penetrates the front wall 140 in the depthwise direction 53. When the bracket 90 is assembled to the cartridge body 31, the ink supply portion 34 of the inner frame 35 is exposed outside through the hole 97. Thus, the hole 97 is formed so as to correspond to the ink supply portion 34 of the inner frame 35 in terms of position, dimension, and shape. The hole 97 is positioned rearward of the hole 96 in the front-rear direction (the depthwise direction 53).

The front wall 140 is provided with a first protrusion 85 and a second protrusion 86. As shown in FIGS. 2 to 4, the first protrusion 85 is formed at an upper end portion of the front wall 140 so as to protrude therefrom in a direction away from the front wall 140 (i.e., frontward, or in the loading direction 56). The hole 96 is formed on a protruding end of the first protrusion 85. The second protrusion 86 is formed at a lower end portion of the front wall 140 so as to protrude therefrom in a direction away from the front wall 140 (i.e., frontward, or in the loading direction 56). The hole 97 is positioned between the through-hole 95 and the second protrusion 86 with respect to the height direction 52.

Figure 6:
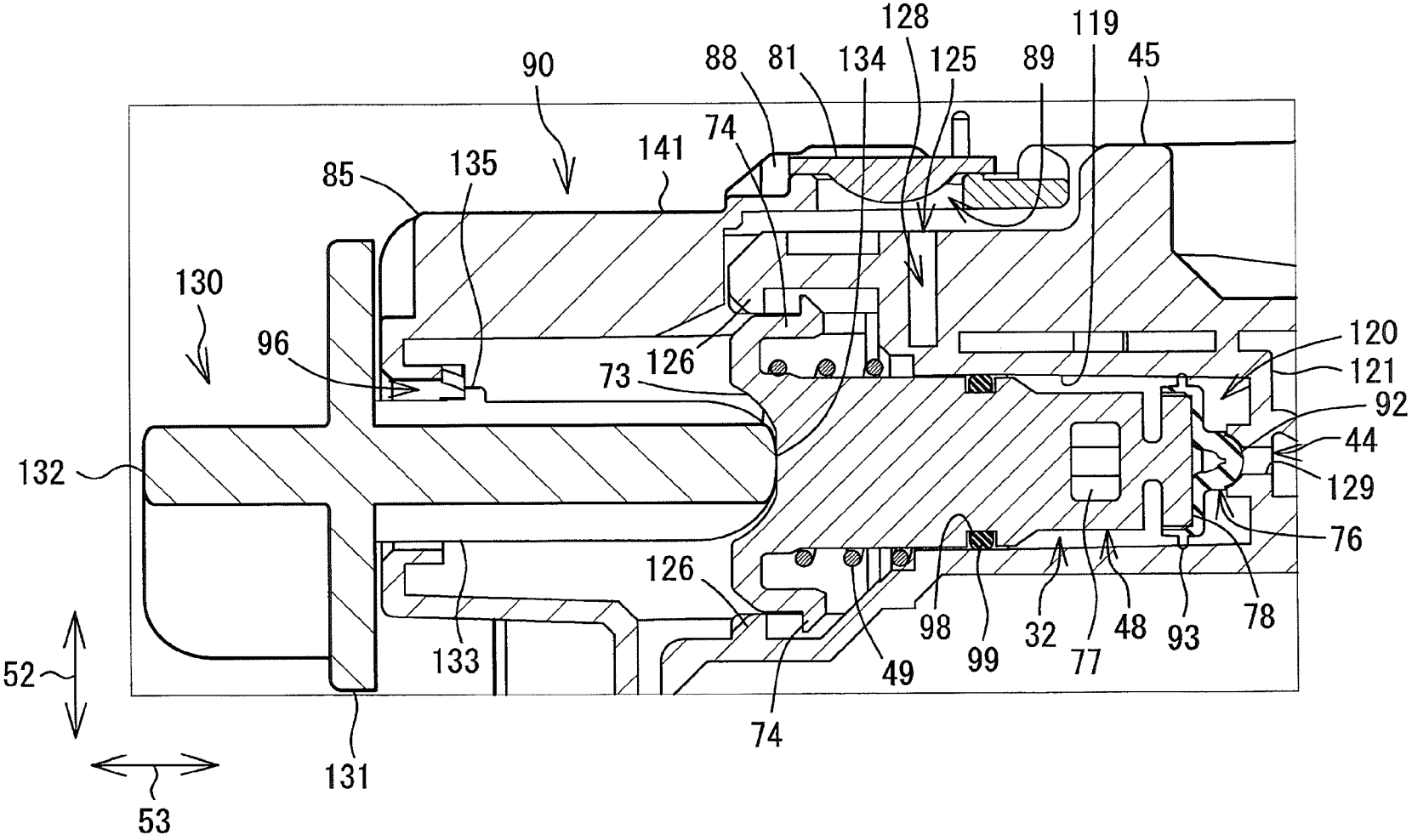
FIG. 6 is an enlarged view of an essential portion of the ink cartridge enclosed by a rectangle shown in FIG. 5, the essential portion including a valve chamber and a valve disposed within the valve chamber.

The upper wall 141 of bracket 90 is formed with an opening 89 (see FIG. 6) penetrating the upper wall 141 in the height direction 52. Referring to FIG. 6, in the state wherein the inner frame 35 has been inserted in the bracket 90, the opening 89 serves to expose an air communication port 125 formed in the inner frame 35 to atmosphere, as will be described later. Thus, the opening 89 is formed so as to correspond to the air communication port 125 of the inner frame 35 in terms of position, dimension, and shape. Specifically, the opening 89 has a diameter larger than that of the air communication port 125. The opening 89 is positioned to be spaced away from the air communication port 125 but is aligned with the air communication port 125 in the height direction 52.

A supporting portion 88 is formed adjacent to the opening 89 on the upper wall 141. The supporting portion 88 is adapted to receive a memory chip 81 having a rectangular flat plate-like shape. Specifically, the supporting portion 88 has a claw-like shape to be engaged with a peripheral end of the memory chip 81. When the memory chip 81 is coupled to the supporting portion 88, the opening 89 is closed by (covered with) the memory chip 81. Instead of the claw-like shape, the supporting portion 88 may be formed as a surface to which an adhesive tape can be attached for fixing a back side of the memory chip 81. Or the memory chip 81 may be fixed to the supporting portion 88 by melting a boss-shaped resin.

The memory chip 81 is a flat plate-shaped substrate having a top surface on which electrodes (shown without reference numerals) are disposed. The memory chip 81 also includes an IC configured to store various electrical signals. More specifically, the IC is configured to store various information on the ink cartridge 30 as electrical signals: for example, information on a type of the ink cartridge 30, such as an ink color, ink component, and initial amount of ink stored in the ink chamber 36.

The electrodes of the memory chip 81 are exposed upward to allow electrical connection thereto by external access. When the ink cartridge 30 is mounted in the cartridge accommodating section 110, electrical contacts 106 (FIG. 1) provided on the cartridge accommodating section 110 electrically contact the electrodes to achieve power supply to the memory chip 81, thereby enabling the information stored in the IC to be retrieved therefrom.

(3-3) Inner Frame

As shown in FIGS. 3 and 4, the inner frame 35 is formed in a rectangular ring-like shape (or frame-like shape) whose pair of surfaces opposed to each other in the widthwise direction 51 are partially open. Each of the opened surfaces is sealed by the film 82 (see FIG. 1) to form the ink chamber 36 in the inner frame 35 for storing ink.

The inner frame 35 has a front wall 40 serving to partially define the ink chamber 36. The front wall 40 opposes the front wall 140 of the bracket 90 in the depthwise direction 53 when the inner frame 35 is inserted in the bracket 90. The inner frame 35 is provided with the detection portion 33, the ink supply portion 34, the air communication portion 120, and a valve chamber 32.

The detecting portion 33 protrudes frontward (in the loading direction 56) from the front wall 40 at a generally intermediate position in the height direction 52. The detecting portion 33 has a box-like shape whose one end is open so as to allow the ink in the ink chamber 36 to be in fluid communication with the detecting portion 33 via the open end. The detecting portion 33 is exposed outside of the bracket 90 through the through-hole 95 when the bracket 90 is assembled to the cartridge body 31. The detecting portion 33 has a pair of side walls made from a light transmissive resin. In the present embodiment, these side walls are configured to allow the light emitted from the optical sensor 114 (FIG. 1) to pass therethrough in the direction perpendicular to the loading/unloading direction 50 (i.e., the widthwise direction 51 or horizontal direction). The light may be infrared light or visible light.

The detecting portion 33 provides therein a hollow space between the pair of side walls such that ink can be present therebetween. Within this hollow space, an indicator 62 of a sensor arm 60 is movably positioned, as shown in FIG. 1.

Figure 5:
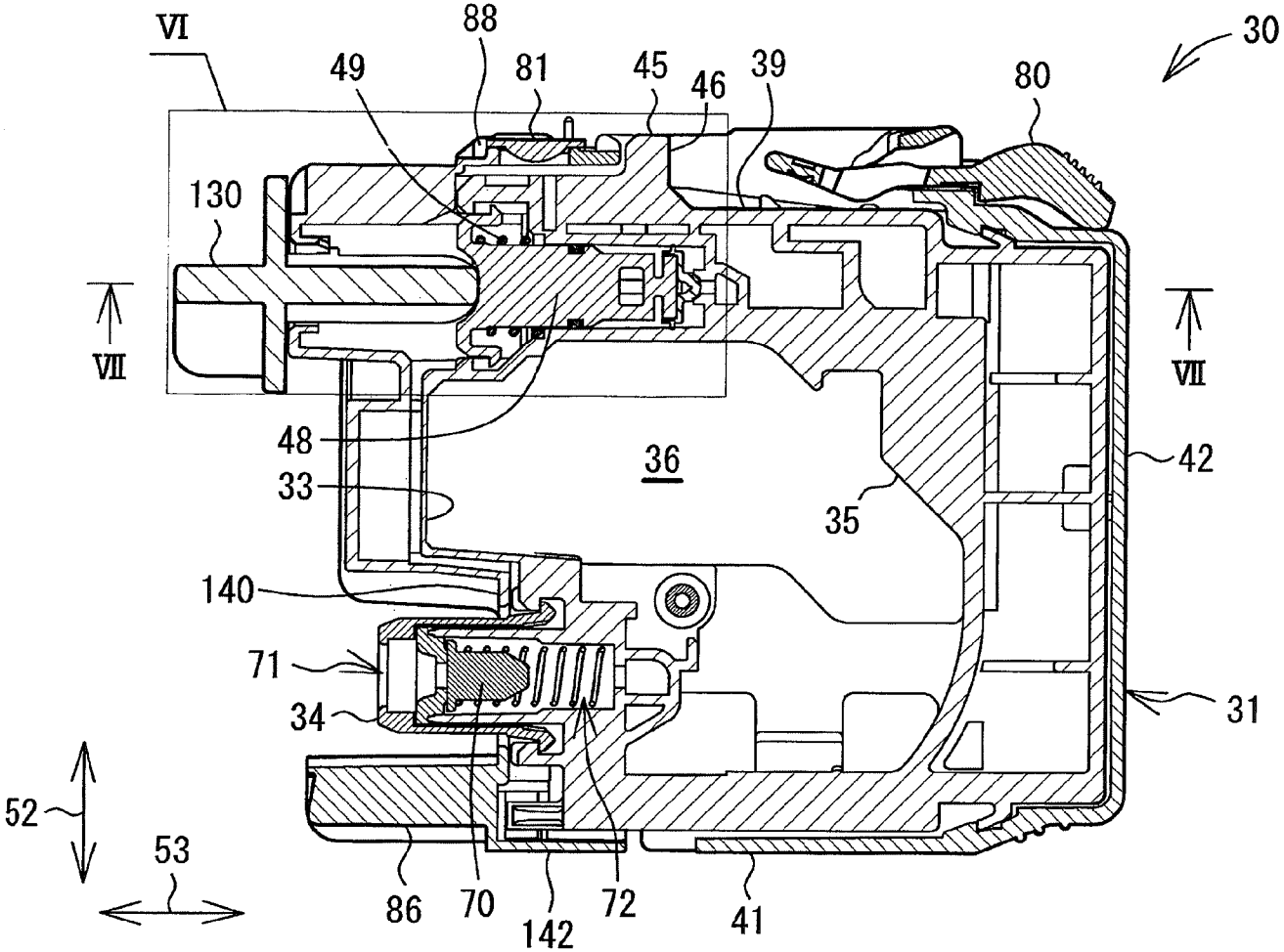
FIG. 5 is a vertical cross-sectional view showing the internal structure of the ink cartridge according to the embodiment, wherein the release member has been assembled to the ink cartridge.

The sensor arm 60 is pivotably movably provided in the ink chamber 36. The sensor arm 60 includes an arm body 61 and a pivot shaft 64. The arm body 61 is plate-like shaped, and is pivotally movably supported to the pivot shaft 64. The pivot shaft 64 extends in the widthwise direction 51 and is supported to the inner frame 35. The arm body 61 has one free end provided with the indicator 62 movably positioned in the hollow space of the detecting portion 33, and another free end provided with a float 63 dipped in the ink. With this structure, the sensor arm 60 is adapted to change its pivoting posture in accordance with an amount of the ink in the ink chamber 36 between a lower position in which the indicator 62 approaches a lower wall of the detecting portion 33 and an upper position in which the indicator 62 approaches an upper wall of the detecting portion 33. In FIGS. 4 and 5, the sensor arm 60 is omitted.

With this structure, when the ink cartridge 30 is mounted in the cartridge accommodating section 110, the detecting portion 33 can change its light transmission state between a transmissive state and a non-transmissive state. In the transmissive state, not less than a predetermined amount of infrared light from the optical sensor 114 can be transmitted through the detecting portion 33 as the sensor arm 60 is at the upper position, and in the non-transmissive state, less than the predetermined amount of infrared light is transmitted therethrough (i.e., the light may be shut off or attenuated) as the sensor arm 60 is at the lower position. In accordance with the light transmission state at the detecting portion 33, the printer 10 can detect whether the amount of ink in the ink chamber 36 is less than the prescribed amount.

As shown in FIG. 4, the ink supply portion 34 is provided at the front wall 40 below the detecting portion 33. The ink supply portion 34 has a hollow cylindrical shape protruding from the front wall 40 in the loading direction 56, i.e., frontward in the front-rear direction. The ink supply portion 34 is exposed outside through the hole 97 formed in the bracket 90 when the ink cartridge 30 is assembled.

The ink supply portion 34 has a protruding end in which the ink supply outlet 71 is formed. As shown in FIG. 1, the ink passage 72 is formed inside the ink supply portion 34. The ink passage 72 extends in the depthwise direction 53 so as to permit fluid communication between the ink supply outlet 71 and the ink chamber 36 through the ink passage 72. The ink supply valve 70 is disposed in the ink passage 72 to open and close the ink supply outlet 71.

Upon loading of the ink cartridge 30 into the cartridge accommodating section 110, the ink needle 113 is inserted into the ink supply outlet 71. The ink needle 113 moves the ink supply valve 70 rearward in the front-rear direction to open the ink supply outlet 71. Thus, the ink in the ink chamber 36 is permitted to flow into the ink needle 113 via the ink passage 72. In the present embodiment, the ink flows out in a direction generally coincident with the loading direction 56 (or frontward in the front-rear direction).

Instead of the ink supply valve 70, a film covering the ink supply outlet 71 may be provided. In the latter case, the ink needle 113 breaks the film to open the ink supply outlet 71 upon loading of the ink cartridge 30 into the cartridge accommodating section 110.

As illustrated in FIG. 4, a pair of engagement claws 43 is formed at a lower end portion of the front wall 40 of the inner frame 35. Each engagement claw 43 has a distal end portion that protrudes outward in the widthwise direction 51. The engagement claws 43 define a distance therebetween in the widthwise direction 51 such that the engagement claws 43 can resiliently deform inward in the widthwise direction 51. Upon assembly of the bracket 90 to the cartridge body 31 and the inner frame 35, the distal end portions of the engagement claws 43 respectively enter the pair of elongated holes 91 formed in the bracket 90 and engage inner peripheral surfaces of cylindrical inner walls constituting the elongated holes 91.

The inner frame 35 has an upper wall oriented in the height direction 52. The engaging portion 45 is formed in the upper wall 39. The engaging portion 45 includes the engaging surface 46 extending in the widthwise direction 51 and the height direction 52. The engaging surface 46 is configured to engage the engaging member 145 of the cartridge accommodating section 110 when the ink cartridge 30 has been loaded in the cartridge accommodating section 110. When engaged with the engaging member 145, the engaging portion 45 (engaging surface 46) is adapted to receive (resist) a biasing force acting in the unloading direction 55 to keep the ink cartridge 30 mounted in the cartridge accommodating section 110, the biasing force being generated by the ink supply valve 70 pushing the ink needle 113.

The air communication portion 120 is formed in the inner frame 35 at a position higher than the detection portion 33 in the height direction 52, as shown in FIGS. 4 and 5. The air communication portion 120 is configured to allow the ink chamber 36 to communicate with outside of the ink cartridge 30.

The air communication portion 120 includes an air flow path through which the ink chamber 36 is permitted to communicate with outside. The air communication portion 120 also includes a valve 48, and a coil spring 49 biasing the valve 48.

The air flow path is formed between the ink chamber 36 and outside of the ink cartridge 30 in the inner frame 35. Specifically, the air flow path connects between a communication hole 44 (see FIGS. 6-8) in communication with the ink chamber 36 and the air communication port 125 in communication with atmosphere.

The air communication port 125 is formed on the upper wall 39 at a position frontward of the engaging portion 45 to oppose a back surface of the memory chip 81, as shown in FIG. 6. The air communication port 125 is open on the upper wall 39 and is in communication with an air path 128 (described later) in the height direction 52. As shown in FIG. 2, since the air communication port 125 is covered with the bracket 90 and the memory chip 81 in the assembled ink cartridge 30, a user cannot visually confirm the air communication port 125 from outside. However, the air communication port 125 is in communication with atmosphere (outside of the ink cartridge 30) through minute gaps formed between the bracket 90 and the inner frame 35, for example.

The communication hole 44 is a hole formed in a partition wall 121 that partitions between the valve chamber 32 and the ink chamber 36, as shown in FIG. 6. The communication hole 44 is defined by an inner peripheral wall 129 to penetrate the partition wall 121 in the depthwise direction 53. The valve chamber 32 is a space formed in the inner frame 35 to receive the valve 48. The valve chamber 32 is thus communicable with the ink chamber 36 via the communication hole 44. As shown in FIGS. 5 and 6, the valve chamber 32 is defined by a cylindrical-shaped peripheral wall 119 extending from the partition wall 121 toward the front wall 40 in the depthwise direction 53. The valve chamber 32 thus has an open end near the front wall 40, the open end being opposite to the partition wall 121 in the depthwise direction 53. The peripheral wall 119 defining the valve chamber 32 is formed with a through-hole 122 (see FIGS. 4 and 8) extending to a left wall 123 of the inner frame 35. That is, the through-hole 122 is open on the left wall 123.

The left wall 123 of the inner frame 35 is formed with a winding labyrinth path 124, as shown in FIG. 4. Specifically, the labyrinth path 124 is a space defined by grooves formed in the left wall 123 and the film 82 attached to the left wall 123. As shown in FIG. 4, the labyrinth path 124 is formed to be aligned with the valve chamber 32 in the widthwise direction 51.

The labyrinth path 124 has one end communicating with the through-hole 122, and another end communicating with the air path 128. Specifically, the labyrinth path 124 extends from the through-hole 122 generally rearward, and approaches the upper wall 39 while making U-turns and extending in the depthwise direction 53. Reaching near the upper wall 39, the labyrinth path 124 then extends linearly frontward and finally reaches a through-hole 127 formed in the left wall 123. The through-hole 127 is in communication with the air path 128 that is in communication with the air communication port 125. The air path 128 penetrates the left wall 123 in the widthwise direction 51, extends to the upper wall 39 and penetrates therethrough to be in communication with the air communication port 125.

In this way, the ink chamber 36 can be in communication with atmosphere via the communication hole 44, the valve chamber 32, the through-hole 122, the labyrinth path 124, the through-hole 127, the air path 128, and the air communication port 125. This path for achieving air flow between the ink chamber 36 and outside of the ink cartridge 30 is defined as the air flow path formed in the air communication portion 120.

In the inner frame 35, a pair of engaging claws 126 is formed frontward of the valve chamber 32 near the front wall 40. Specifically, the engaging claws 126 are formed adjacent to the open end of the valve chamber 32 to protrude radially inward of the same. The engaging claws 126 are spaced away from each other in the height direction 52. The engaging claws 126 are adapted to engage with a pair of engaging claws 74 formed on the valve 48 so that the valve 48 is prevented from being popped out from the valve chamber 32 due to a biasing force of the coil spring 49.

The valve 48 is movably disposed within the valve chamber 32. Specifically, the valve 48 is movable (slidable) between a first position shown in FIGS. 6 and 7 and a second position shown in FIG. 8. The valve 48 closes the communication hole 44 at the first position, and opens the communication hole 44 at the second position, as will be described in detail later.

Figure 7:
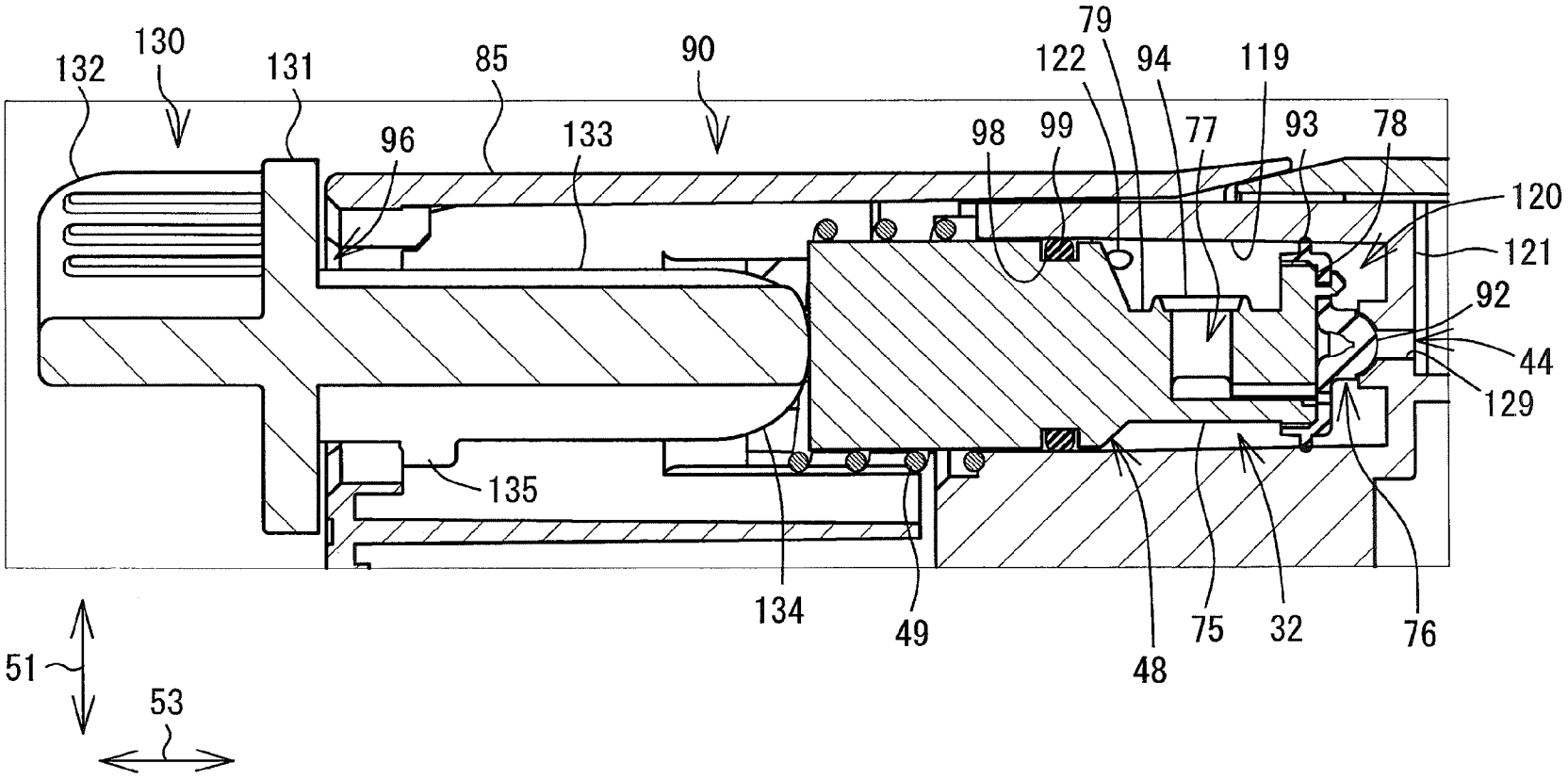
FIG. 7 is an enlarged cross-sectional view of the essential portion of the ink cartridge of the embodiment taken along a plane VII-VII shown in FIG. 5, wherein the valve is in a first position.
Figure 8:
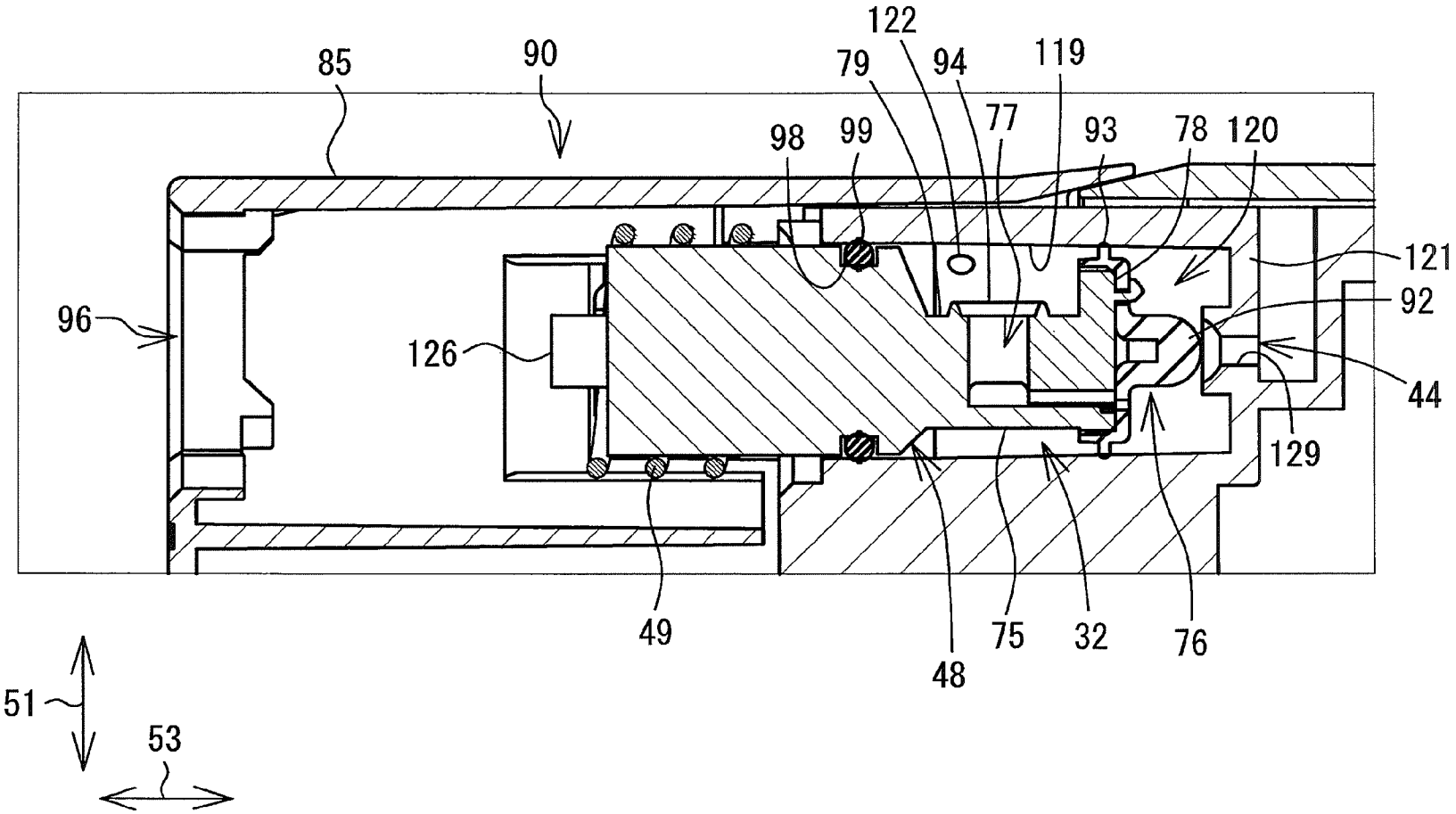
FIG. 8 is an enlarged cross-sectional view of the essential portion of the ink cartridge of the embodiment taken along the plane VII-VII shown in FIG. 5, wherein the valve is in a second position.

As shown in FIGS. 6 through 8, the valve 48 includes a valve main body 75, a sealing member 76, and an O-ring 99.

The valve main body 75 has an outer profile in conformance with the cylindrical-shaped valve chamber 32 so as to be inserted into the same. The valve main body 75 has a generally columnar shape elongated in the depthwise direction 53 and defining an axis extending in the depthwise direction 53. The valve main body 75 has an outer diameter smaller than an inner diameter of the valve chamber 32. Note that the valve main body 75 is not actually columnar shape as a whole, but has an outer contour of a generally columnar shape. The outer contour of the valve main body 75 is formed by various end faces, including end faces of cross-shaped ribs extending radially outward from an axial center portion of the valve main body 75.

The valve main body 75 is formed with an air passage 77 therein. Specifically, the valve main body 75 has an end face 78 configured to oppose the partition wall 121 in the depthwise direction 53, and a side surface 79 configured to face the peripheral wall 119 within the valve chamber 32 (see FIGS. 6 to 8). The air passage 77 has one end that is open on the end face 78, and another end that is open on the side surface 79. In other words, the air passage 77 extends in the depthwise direction 53 (front-rear direction) from the end face 78, and then bends in a direction perpendicular to the depthwise direction 53 (i.e., in the widthwise direction 51) to be open on the end face 78. The air passage 77 is a passage connecting between the end face 78 and the side surface 79 within the valve main body 75 to permit air flow through the air passage 77.

The valve main body 75 has one end on which the pair of engaging claws 74 is formed, the one end being opposite to the end face 78 in the depthwise direction 53. The engaging claws 74 are hook-like shaped and spaced apart from each other in the height direction 52. More specifically, each engaging claws 74 extends outward (upward or downward in the height direction 52) from the one end of the valve main body 75 and then bends toward the end face 78 with a distance kept from an outer surface of the valve main body 75. Each engaging claw 74 has a distal end portion extending away from the outer surface of the valve main body 75 to form a hook-like shape. The engaging claws 74 (precisely, distal end portions thereof) are respectively configured to be engaged with the engaging claws 126 formed at the open end of the valve chamber 32 when the valve 48 is inserted into the valve chamber 32. Due to the engagement between the engaging claws 74 and the engaging claws 126, the valve 48 is prevented from coming out of the valve chamber 32.

Figure 9:
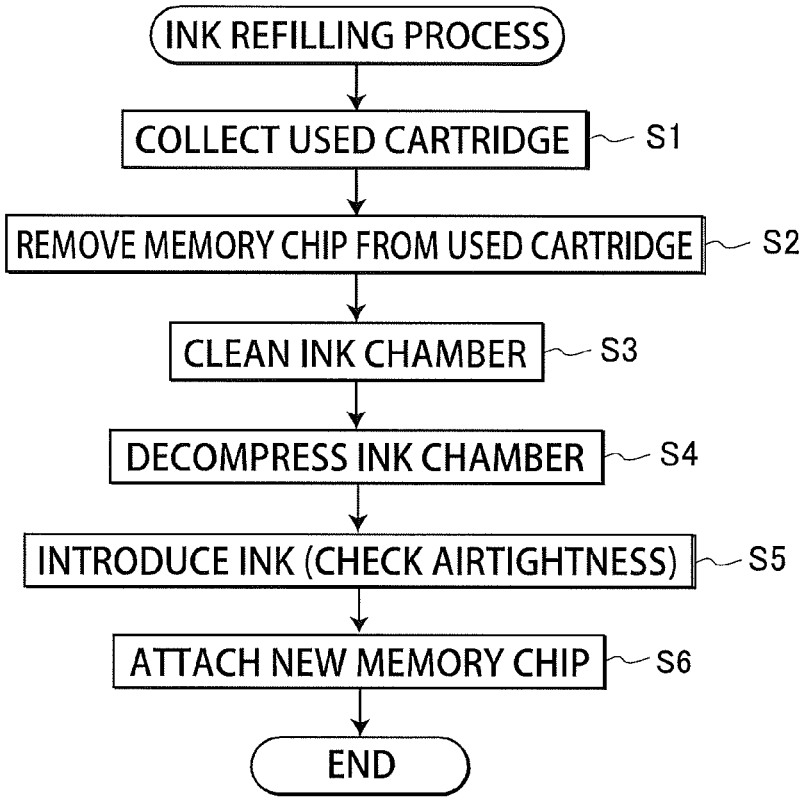
FIG. 9 is a flowchart of a process to refill ink into the used ink cartridge of the embodiment.

The engaging claws 74 define a curved surface 73 therebetween in the height direction 52, as shown in FIGS. 6 and 9. The curved surface 73 has a concaved shape in a side view, being recessed toward the end face 78. The curved surface 73 defines a center that is most recessed toward the end face 78 (deepest position in the depthwise direction 53) and the center is generally coincident with the axis (axial center) of the valve main body 75 and the center of the communication hole 44 formed in the partition wall 121. The curved surface 73 is configured to receive the release member 130 inserted into the valve chamber 32.

The sealing member 76 is provided to cover the end face 78 of the valve main body 75. The sealing member 76 is made of an elastically deformable material, such as rubber and elastomer. The sealing member 76 has a cap-like shape for covering and hermetically sealing the end face 78.

The sealing member 76 includes a protruding portion 92, and a flange portion 93.

The sealing member 76 has a circular-shaped main portion in which a through-hole is formed to penetrate therethrough in the depthwise direction 53. This through-hole is shown without a reference numeral in FIGS. 6-8. This through-hole is formed at a position corresponding to the position of the open end of the air passage 77 on the end face 78.

With this structure, even when the end face 78 of the valve main body 75 is covered (sealed) with the sealing member 76, the air passage 77 is permitted to communicate with the valve chamber 32 (or a portion of the valve chamber 32 facing the partition wall 121) through this hole formed in the sealing member 76.

The protruding portion 92 protrudes in a direction away from the end face 78 from the circular-shaped main portion of the sealing member 76 at a position generally center thereof. The protruding portion 92 has a dome-like shape, defining a hollow space therein. The protruding portion 92 is so sized that the protruding portion 92 can be in close contact with the inner peripheral wall 129 defining the communication hole 44, thereby realizing sealing of the communication hole 44.

The flange portion 93 is formed to protrude radially outward from an entire circumferential portion of the main portion of the sealing member 76. The flange portion 93 has a ring-like shape (0-shape) in a plan view, and functions as an O-ring. The flange portion 93 is configured to be in close contact with and in sliding contact with the peripheral wall 119 of the valve chamber 32. The flange portion 93 thus serves to partition a portion of the valve chamber 32 facing the partition wall 121 (on the side of the end face 78) from a remaining portion of the valve chamber 32 (on the side of the side surface 79).

The other end of the air passage 77 that is open on the side surface 79 of the valve main body 75 is covered with a semipermeable membrane 94, as shown in FIGS. 7 and 8. The semipermeable membrane 94 is made of a porous membrane having minute holes and is configured to allow passage of air but restrict passage of liquid (i.e., ink in the present embodiment). For example, the semipermeable membrane 94 may be made of a fluorine resin, such as polytetrafluoroethylene, polychlorotrifluoroethylene, tetrafluoroethylene-hexafluoropropylen copolymer, tetrafluoroethylene-perfluoroalkylvinylether copolymer, and tetrafluoroethylene-ethylene copolymer.

With this structure, since the open end of the air passage 77 on the side surface 79 is closed by the semipermeable membrane 94 that permits air flow but restricts passage of ink, ink is prevented from flowing into the labyrinth path 124 that is positioned downstream of the semipermeable membrane 94 (closer to the air communication port 125 than the semipermeable membrane 94 to the air communication port 125) in the air flow path of the ink cartridge 30.

The valve main body 75 is further formed with a groove 98 between the engaging claws 74 and the open end of the air passage 77 on the side surface 79. The groove 98 extends along a periphery (circumference) of the valve main body 75 to fittingly receive the O-ring 99 therein. As shown in FIGS. 7 and 8, the O-ring 99 is configured to be in sliding contact with and in close contact with the peripheral wall 119 of the valve chamber 32 to realize air-tight sealing of the valve chamber 32. Due to this gastight sealing of the valve chamber 32 by the O-ring 99, evaporation of moisture from ink can be prevented in the air flow path of the ink cartridge 30. Moreover, due to the provision of the O-ring 99, the labyrinth path 124 is communicable with atmosphere only through the air communication port 125 in the air flow path. The intricate construction of the labyrinth path 124 by itself also serves to suppress ink from getting dried by communication with ambient air through the air communication port 125.

As shown in FIGS. 5 to 6, in a state where the valve 48 has been inserted in the valve chamber 32, the coil spring 49 is disposed between a peripheral portion of the inner frame 35 defining the open end of the valve chamber 32 and the engaging claws 74. The valve 48 is thus normally biased in a direction away from the partition wall 121 (leftward in FIGS. 5 and 6, or frontward) by the biasing force of the coil spring 49.

Specifically, upon receipt of the biasing force of the coil spring 49, the valve 48 is urged to move frontward, but the engaging claws 74 of the valve main body 75 are engaged with the engaging claws 126 of the inner frame 35 to prevent the valve 48 from coming out of the valve chamber 32. The valve 48 is thus retained in the second position, as shown in FIG. 8. At this time, the protruding portion 92 of the sealing member 76 is separated from the communication hole 44. The communication hole 44 is thus opened when the valve 48 is in the second position.

In contrast, in the first position as shown in FIGS. 6 and 7, the valve 48 is pressed rearward (rightward in FIGS. 5 to 7) by the release member 130 inserted in the valve chamber 32 against the biasing force of the coil spring 49. The protruding portion 92 of the sealing member 76 is thus tightly fitted with the inner peripheral wall 129 to close the communication hole 44. At this time, the engaging claws 126 and the engaging claws 74 are separated from each other in the depthwise direction 53 by a prescribed distance, as shown in FIG. 6. In other words, this distance by which the engaging claws 74 in the first position are separated from the engaging claws 126 is equivalent to a distance by which the valve 48 is movable in the depthwise direction 53.

While the valve 48 is retained at the second position, the ink chamber 36 is permitted to be in communication with ambient air through the air flow path defined in the ink cartridge 30. Specifically, the air flow path is configured of: the communication hole 44; the valve chamber 32 (a space defined between the partition wall 121 and the flange portion 93, the air passage 77, and a space defined between the flange portion 93 and the O-ring 99), the through-hole 122, the labyrinth path 124, the air path 128, and the air communication port 125.

(3-4) Release Member

The release member 130 is assembled to the hole 96 of the bracket 90, as shown in FIGS. 2 and 5 to 7. As described above, when assembled to the bracket 90, the release member 130 pushes the valve 48 rearward to maintain the valve 48 at the first position against the biasing force of the coil spring 49.

The release member 130 includes a base 131, a handling rib 132 and a rod 133. The base 131 has a flat plate-like shape. The base 131 has a front surface from which the handling rib 132 protrudes frontward, and a rear surface from which the rod 133 protrudes rearward. The rear surface of the base 131 can abut on the protruding end of the first protrusion 85 of the bracket 90.

The handling rib 132 is thin plate-like shaped and has a size that permits a user to hold the handling rib 132 with his fingers (see FIG. 2).

The rod 133 is a cross-shaped rib extending in the depthwise direction 53. The rod 133 is sized to be insertable into the hole 96 of the bracket 90. The rod 133 is formed in a front-rear length suitable for pressing the valve 48 into the first position. More specifically, the rod 133 has a tip end portion (more specifically, a leading surface 134) that is configured to abut on the curved surface 73 of the valve 48 while the release member 130 is being inserted into the hole 96 for assembly to the bracket 90. In a state where the release member 130 has been assembled to the bracket 90 and the rear surface of the base 131 is in abutment with the protruding end of the first protrusion 85 of the bracket 90, the valve 48 has been pushed rearward into the valve chamber 32 to be maintained at the first position against the biasing force of the coil spring 49, while the leading surface 134 is in abutment with the curved surface 73. At this time, since the center of the curved surface 73 is generally coincident with the axial center of the valve main body 75, the release member 130 applies load to the valve main body 75 against the biasing force of the coil spring 49 in a direction coincident with the axial center of the valve main body 75.

The rod 133 includes a pair of engaging protrusions 135 protruding radially outward (see FIG. 4 in which only one of the engaging protrusions 135 is shown). The engaging protrusions 135 are positioned to be spaced away from the base 131 (rear surface of the base 131) by a distance corresponding to a thickness of a wall constituting the protruding end of the first protrusion 85 of the bracket 90. The engaging protrusions 135 are formed to diametrically oppose each other with respect to an axis of the rod 133 in correspondence with the cutouts 136 formed on a peripheral portion of the hole 96 (see FIG. 3). When the release member 130 is inserted into the hole 96, the engaging protrusions 135 are positionally aligned with the cutouts 136 to pass therethrough in the depthwise direction 53.

Once inserted into the hole 96, the release member 130 is moved either counterclockwise or clockwise about the axis of the rod 133. The engaging protrusions 135 of the rod 133 are thus displaced such that the engaging protrusions 135 are no longer positionally coincident with the cutouts 136. As a result, the engaging protrusions 135 abut against t the peripheral portion of the hole 96, thereby maintaining the release member 130 inserted in the hole 96 against a reaction force from the valve 48, i.e., the biasing force of the coil spring 49. The release member 130 has been assembled to the bracket 90 in this way, as shown FIG. 2. At this time, the handling rib 132 protrudes from the front wall 140 of the bracket 90 outward (frontward), i.e., in a direction the same as that in which the ink supply portion 34 protrudes.

4. How to Realize Air Communication in the Ink Cartridge

In an unused state of the ink cartridge 30, the ink chamber 36 is maintained at a negative pressure. The release member 130 assembled to the bracket 90 (see FIG. 2) pushes the valve 48 to be maintained at its first position against the biasing force of the coil spring 49, thereby causing the protruding portion 92 of the sealing member 76 to be in intimate contact with the inner peripheral wall 129 defining the communication hole 44 in the partition wall 121 to close the communication hole 44, as shown in FIG. 7. The ink chamber 36 is isolated from outside and ink leakage from the ink chamber 36 is prevented. Hence, ink is prevented from reaching (and thus adhering to) the semipermeable membrane 94 that is positioned closer to outside than the communication hole 44 in the air flow path defined in the air communication portion 120.

Upon use of the ink cartridge 30, a user removes the release member 130 from the bracket 90. More specifically, the user rotates the release member 130 with holding the handling rib 132 such that the engaging protrusions 135 are aligned with the cutouts 136 in the depthwise direction 53. Upon alignment of the engaging protrusions 135 with the cutouts 136 in the depthwise direction 53, since the rod 133 of the release member 130 is applied with the biasing force of the coil spring 49, the rod 133 is pushed outward (frontward) due to the biasing force of the coil spring 49.

As shown in FIG. 8, as the rod 133 is coming out of the hole 96, the valve 48 moves from the first position to the second position. When the valve 48 has moved from the first position to the second position, the protruding portion 92 of the sealing member 76 is separated from the inner peripheral wall 129 to open the communication hole 44. As a result, the ink chamber 36 is brought into communication with atmosphere through the communication hole 44, the valve chamber 32 (the space defined between the partition wall 121 and the flange portion 93, the air passage 77, the valve chamber 32 (the space defined between the flange portion 93 and the O-ring 99), the through-hole 122, the labyrinth path 124, and the air communication port 125. The ink chamber 36 is thus brought into atmospheric pressure.

5. Refilling of Ink

When the ink cartridge 30 is mounted in the cartridge accommodating section 110 for use and the ink stored in the ink chamber 36 is substantially consumed, the used ink cartridge 30 will be discarded. In the used ink cartridge 30, no ink may be left in the ink chamber 36, or a small amount of ink may be left in the ink chamber 36. For example, such used ink cartridge 30 can be collected in a collection box placed in a PC store that sells the printers 10. Once collected, the used ink cartridge 30 is washed and then ink is refilled into the ink chamber 36. As a result, the used ink cartridge 30 is recycled as a new ink cartridge 30.

Now how to refill ink into the ink chamber 36 of the collected used ink cartridge 30 will be described with reference to FIG. 9.

First, the memory chip 81 is removed from the bracket 90 in the used ink cartridge 30 (S1, S2). Removal of the memory chip 81 exposes the air communication port 125 formed in the upper wall 141 of the inner frame 35 through the opening 89 of the bracket 90 (refer to FIG. 6). The air communication port 125 is now accessible from above. The ink chamber 36 is then washed and cleaned (S3).

Then, a nozzle (not shown) for decompressing the ink chamber 36 is inserted into the exposed air communication port 125 (S4). In a used state of the ink cartridge 30, the communication hole 44 is opened since the valve 48 is in the second position due to the biasing force of the coil spring 49. Since the ink chamber 36 and the valve chamber 32 are in communication with each other, decompression of the ink chamber 36 can be done through the air communication port 125 that is in communication with the valve chamber 32.

Incidentally, at this time, the ink supply outlet 71 is closed by the ink supply valve 70 in the ink supply portion 34. Therefore, air never flows into the ink chamber 36 through the ink supply outlet 71.

After the ink chamber 36 is depressurized, another nozzle (not shown) is inserted into the ink supply outlet 71 for injecting ink into the ink chamber 36 (S5). Since the ink chamber 36 is in a decompressed state, ink can flow into the ink chamber 36 from the nozzle through the ink passage 72. As a larger amount of ink is injected into the ink chamber 36, pressure of an air layer (decompressed state) available within the ink chamber 36 gradually becomes closer to atmospheric pressure, casing the ink flow from the nozzle to stop. In this way, ink is introduced into the ink chamber 36 through the ink supply portion 34.

By sucking a predetermined amount of air through the air communication port 125, the decompressed state within the ink chamber 36 can be maintained constant and a predetermined amount of ink can flow into the ink chamber 36 from the nozzle.

Suppose that a pinhole is formed somewhere between the inner frame 35 and the film 82 attached to the inner frame 35.

Under such circumstances, suction of the predetermined amount of air does not bring the ink chamber 36 into the desired decompressed state, since air enters into the ink chamber 36 though the pinhole. As a result, less than the predetermined amount of ink is introduced into the ink chamber 36 through the ink supply portion 34.

In this way, measuring how much ink has been introduced into the decompressed ink chamber 36 can help to determine whether or not airtightness of the space defined by the inner frame 35 and the film 82 is maintained, i.e., whether airtightness of the ink chamber 36 and the labyrinth path 124 is preserved in the used ink cartridge 30. The amount of ink introduced into the ink chamber 36 can be measured, for example, by visually confirming the inner frame 35 or by measuring how much ink has decreased in an ink tank connected to the nozzle through which ink is injected into the ink chamber 36.

Once the predetermined amount of ink has been introduced in the ink chamber 36, the nozzles inserted in the air communication port 125 and the ink supply portion 34 are respectively removed therefrom. A new memory chip 81 is then attached to the supporting portion 88 of the bracket 90 (S6). This new memory chip 81 now closes the opening 89 that has exposed the air communication port 125.

A new release member 130 is assembled to the hole 96 of the bracket 90 to push the valve 48 into the first position. Accordingly, the protruding portion 92 of the sealing member 76 closes the communication hole 44.

If necessary, before a new memory chip 81 is attached to the bracket 90, the air layer within the ink chamber 36 can be decompressed through the air communication port 125 and the release member 130 can be assembled to the bracket 90 to close the communication hole 44. After the communication hole 44 is closed, the new memory chip 81 is finally attached to the bracket 90.

6. Operations and Technical Advantages

According to the structure of the depicted embodiment, the air communication port 125 is covered with the memory chip 81 when the ink cartridge 30 is in use. Hence, foreign objects are restricted from entering into the air flow path formed in the ink cartridge 30 through the air communication port 125.

In order to produce a new ink cartridge 30 from the used ink cartridge 30, the memory chip 81 needs to be removed from the used ink cartridge 30 for replacement. When the old memory chip 81 is removed, the air communication port 125 is exposed. This exposed air communication port 125 can be utilized for decompression of the ink chamber 36 to perform refilling of ink into the ink chamber 36, before attachment of a new memory chip 81. With this structure of the ink cartridge 30 (arrangement of the memory chip 81 relative to the air communication port 125), no extra operation is necessitated solely for refilling of ink.

Further, airtightness of the space defined by the inner frame 35 and the film 82 (such as the ink chamber 36 and the labyrinth path 124), i.e., whether there is any pinhole anywhere between the inner frame 35 and the film 82 attached to the inner frame 35 (in the labyrinth path 124 or in the ink chamber 36) can be checked (confirmed) based on the amount of ink introduced into the decompressed ink chamber 36 of the used ink cartridge 30.

Incidentally, instead of measuring the amount of ink, airtightness may also be confirmed by measuring an amount of decompression within the ink chamber 36 (a value indicative of how much the ink chamber 36 is decompressed) in association with the process to decompress the ink chamber 36 (S4).

Further, since the valve 48 closes and opens the communication hole 44, decompression and sealing of the ink chamber 36 can be realized with ease. Further, the sealing performance of the O-ring 99 within the valve chamber 32 can also be confirmed by checking the airtightness of the ink chamber 36.

Further, the semipermeable membrane 94 is attached to the valve main body 75 of the valve 48. Therefore, ink is prevented from flowing out through the air communication port 125 while the ink chamber 36 is depressurized. Also, checking whether ink flows out from the air communication port 125 also renders it possible to confirm whether the semipermeable membrane 94 is damaged or not.

Further, the semipermeable membrane 94 is attached to the valve main body 75 of the valve 48, not attached to the peripheral wall 119 of the valve chamber 32. This means that, the semipermeable membrane 94 can be attached to the valve main body 75 in a state where the valve main body 75 is removed from the valve chamber 32. Thus, providing the semipermeable membrane 94 in the air flow path formed is easier, and assembly of the ink cartridge 30 can be facilitated, compared to a case in which the semipermeable membrane 94 is attached to somewhere within the valve chamber 32.

Further, in the inner frame 35, the air communication port 125 is formed in the upper wall 39 to which the film 82 is not attached. This means that an arrangement (structure) for preventing interference between the air communication port 125 and the film 82 is not required to be provided on the upper wall 39. The upper wall 39 can therefore be made compact, and enhanced space arrangement in the ink cartridge 30 can be realized.

Further, in the upstanding posture, the air communication port 125 is positioned higher than the ink supply portion 34 in the height direction 52. That is, the upper surface 39 (in which the air communication port 125 is formed) is positioned farther from the ink supply portion 34 than the lower wall 41 from the ink supply portion 34. Further, the direction in which the air communication port 125 is open (i.e., upward) is different from the direction in which the ink supply outlet 71 of the ink supply portion 34 extends from the inner frame 35 (i.e., frontward). That is, the direction in which the air communication port 125 is oriented is different from the direction in which the ink supply portion 34 is oriented. This structure serves to prevent occurrence of interference between the nozzle connected to the air communication port 125 and the nozzle connected to the ink supply portion 34.

Further, in the ink cartridge 30 of the present embodiment, the sealing member 76 and a part of the air flow path are provided within the valve chamber 32. Space within and in the vicinity of the valve chamber 32 is therefore effectively utilized.

Although a part of the air flow path (air passage 77) is formed in the valve 48 in the depicted embodiment, the air flow path in its entirety may be formed in the inner frame 35 if the valve 48 is not used in the ink cartridge 30.

Specifically, for example, a chamber that constitutes a part of the air flow path is formed in the inner frame 35 and a foam may be disposed within the chamber to absorb ink. In this case, the chamber filled with the foam is in communication with the labyrinth path 124 at a position closer to the ink chamber 36 than the labyrinth path 124 to the ink chamber 36 in the air flow path. Alternatively, a semipermeable membrane for closing the air flow path may be directly attached to the inner frame 35 at a position closer to the ink chamber 36 than the labyrinth path 124 to the ink chamber 36 in the air flow path. With these structures without the valve 48, communication between the ink chamber 36 and ambient air can be achieved, while ink leakage can be prevented.

While the invention has been described in detail with reference to the specific embodiment thereof, it would be apparent to those skilled in the art that various changes and modifications may be made therein without departing from the scope of the invention.

What is claimed is:

1. An ink cartridge comprising:

a cartridge body defining an ink chamber therein for storing ink, the cartridge body having a first outer surface and an air communication port formed to be open on the first outer surface, the first outer surface being oriented in a first direction;

an ink supply portion provided at the cartridge body and configured to supply the ink stored in the ink chamber to outside;

an air flow path provided in the cartridge body, the air flow path being configured to be in communication with the ink chamber through a communication hole and in communication with ambient air through the air communication port to permit the ink chamber to communicate with ambient air through the air flow path;

a cover covering the first outer surface of the cartridge body, the cover being formed with an opening at a position aligned with the air communication port in the first direction, the air communication port being positioned to be spaced away from the opening in the first direction to define a gap therebetween, the gap being in communication with a space formed between the cartridge body and the cover; and a memory chip disposed on the cover to close the opening and configured to store information, external access to the memory chip permitting the information to be electrically retrieved therefrom.

2. The ink cartridge as claimed in claim 1, wherein the air communication port has a diameter smaller than a diameter of the opening.

3. The ink cartridge as claimed in claim 1, further comprising a valve configured to move between a first position to close the communication hole and a second position to open the communication hole.

4. The ink cartridge as claimed in claim 1, further comprising:

a semipermeable membrane disposed in the air flow path to close the air flow path; and a labyrinth path disposed in the air flow path and in communication with ambient air.

5. The ink cartridge as claimed in claim 4, further comprising:

a valve configured to open and close the communication hole, the valve having a main body and an air passage formed therein to permit air flow through the air passage; and a sealing member provided on the valve main body of the valve, wherein the air flow path comprises a valve chamber configured to movably accommodate the valve therein, the valve chamber having one end in communication with the ink chamber via the communication hole and another end in communication with ambient air via the labyrinth path; and wherein the sealing member seals the valve chamber to prevent ink flow between the one end and the another end within the valve chamber, the air passage permitting air flow between the one end and another end of the valve chamber through the air passage to constitute a part of the air flow path, the semipermeable membrane being provided on the valve to close the air passage.

6. The ink cartridge as claimed in claim 1, wherein the cartridge body further comprises a frame and two films attached to the frame, the frame having the first outer surface and two opposing surfaces oriented in a direction intersecting the first direction, each of the two opposing surfaces having an opening and each of the two films closing a corresponding one of the openings to define the ink chamber.

7. The ink cartridge as claimed in claim 1, wherein the cartridge body further comprises a second outer surface oriented in the first direction; and wherein the ink supply portion is oriented in a second direction intersecting the first direction, the first outer surface being positioned farther from the ink supply portion than the second outer surface from the ink supply portion.

8. The ink cartridge as claimed in claim 1, wherein the memory chip is configured to store information on the ink cartridge.

9. A method of producing an ink cartridge comprising:

preparing an ink cartridge, the ink cartridge comprising: a cartridge body defining an ink chamber therein for storing ink, the cartridge body having an outer surface and an air communication port formed to be open on the outer surface, the outer surface being oriented in a direction; an ink supply portion provided at the cartridge body and configured to supply the ink stored in the ink chamber to outside; an air flow path provided in the cartridge body, the air flow path being configured to be in communication with the ink chamber through a communication hole and in communication with ambient air through the air communication port to permit the ink chamber to communicate with ambient air through the air flow path; a cover covering the outer surface of the cartridge body, the cover being formed with an opening at a position aligned with the air communication port in the direction, the air communication port being positioned to be spaced away from the opening in the direction to define a gap therebetween, the gap being in communication with a space formed between the cartridge body and the cover; and a memory chip disposed on the cover to close the opening and configured to store information, external access to the memory chip permitting the information to be electrically retrieved therefrom;

removing the memory chip from the cover of the ink cartridge to expose the air communication port through the opening of the cover;

decompressing the ink chamber through the air communication port;

introducing ink into the decompressed ink chamber through the ink supply portion; and attaching a new memory chip to the cover to close the opening and to cover the air communication port such that the gap defined between the opening closed by the new memory chip and the air communication port covered by the new memory chip is in communication with the space formed between the cartridge body and the cover.

10. The method as claimed in claim 9, further comprising confirming airtightness of the cartridge body including the ink chamber based on how much ink is introduced into the decompressed ink chamber.

11. The method as claimed in claim 9, further comprising confirming airtightness of the cartridge body including the ink chamber based on by how much the ink chamber is decompressed.

12. An ink cartridge comprising:

a cartridge body defining an ink chamber therein for storing ink, the cartridge body having an outer surface and an air communication port formed on the outer surface;

an ink supply portion provided at the cartridge body and configured to supply the ink stored in the ink chamber to outside;

an air flow path provided in the cartridge body, the air flow path being configured to be in communication with the ink chamber through a communication hole and in communication with ambient air through the air communication port to permit the ink chamber to communicate with ambient air through the air flow path;

a cover configured to cover the outer surface of the cartridge body, the cover being formed with an opening for exposing the air communication port through the opening, the air communication port being positioned to be spaced away from the opening in a direction to define a gap therebetween, the gap being in communication with a space formed between the cartridge body and the cover; and a memory chip disposed on the cover to close the opening and configured to store information, external access to the memory chip permitting the information to be electrically retrieved therefrom.

* * * * *